US005410810A

United States Patent [19]

Gillibrand

[11] Patent Number: 5,410,810

[45] Date of Patent: May 2, 1995

[54] SAFETY RAZORS

[75] Inventor: Robert Gillibrand, Reading, United Kingdom

[73] Assignee: The Gillette Company, Boston, Mass.

[21] Appl. No.: 30,079

[22] PCT Filed: Oct. 10, 1991

[86] PCT No.: PCT/US91/07468

§ 371 Date: May 27, 1993

§ 102(e) Date: May 27, 1993

[87] PCT Pub. No.: WO92/06827

PCT Pub. Date: Apr. 30, 1992

[30] Foreign Application Priority Data

Oct. 22, 1990 [GB] United Kingdom ..... 9022945

[51] Int. Cl.[6] ..... B26B 21/18

[52] U.S. Cl. ..... 30/41; 30/50; 30/81; 30/84

[58] Field of Search ..... 30/50, 41, 49, 77, 84, 30/81, 82

[56] References Cited

U.S. PATENT DOCUMENTS

| | | | |
|---|---|---|---|
| 4,443,939 | 4/1984 | Motta et al. | 30/49 |
| 4,516,320 | 5/1985 | Peleckis | 30/49 |
| 4,535,537 | 8/1985 | Ferraro et al. | 30/50 X |
| 4,624,051 | 11/1986 | Apprille, Jr. et al. | 30/41 X |
| 4,754,548 | 7/1988 | Solow | 30/50 |
| 4,854,043 | 8/1989 | Chen | 30/49 X |
| 5,031,316 | 7/1991 | Oldroyd | 30/49 X |

*Primary Examiner*—Rinaldi I. Rada
*Attorney, Agent, or Firm*—Donal B. Tobin

[57] ABSTRACT

A safety razor having one or more blades seated between a cap and guard, said guard cap and guard having a comb-like configuration in which a comb-like moulding of a mixture of polyethylene oxide and a structural polymer, such as polystyrene, is positioned between the teeth of the comb-like cap portion, the teeth of the polyethylene oxide-containing moulding being narrower than the space between the teeth of the cap portion so that the blade unit can flex concavely.

2 Claims, 2 Drawing Sheets

SAFETY RAZORS

SAFETY RAZORS

This invention is concerned with safety razors which comprise a flexible razor blade unit secured to a handle by connecting means arranged to permit flexure of the unit when the razor is used.

BACKGROUND OF THE INVENTION

The blade unit is flexible in the sense that it is readily flexible, in response to forces encountered during normal use, about an axis or axes parallel with the plane of the blade unit and extending substantially perpendicular to the cutting edge(s) of the blade(s). Safety razors of this kind are described for example, in British Specifications 1589591 and 2119690.

One form of blade unit for such a safety razor comprises a flexible blade or tandem flexible blades with a flexible spacer therebetween, which blade or blades and spacer are mounted in a moulded plastics housing providing a comb-like guard portion and a comb-like cap portion, the teeth of the two comb-like portions being interconnected by a web which is sufficiently thin to be flexible. The blade unit is connected to a razor handle by connecting means which permit flexing of the blade unit in use.

SUMMARY OF THE INVENTION

We have now developed an improvement of such a safety razor in which a comb-like moulding of a mixture of polyethylene oxide and a structural polymer, such as polystyrene, is positioned between the teeth of the comb-like cap portion, the teeth of the polyethylene oxide-containing moulding being narrower than the space between the teeth of the cap portion so that the blade unit can flex concavely.

According to the present invention, there is provided a safety razor which comprises a razor blade unit which is readily flexible, in response forces encountered during normal use, about an axis or axes parallel with the plane of the blade or blades and extending substantially perpendicular to the cutting edge(s) thereof, a handle, and connecting means connecting the blade unit to the handle which means permit flexing of the blade unit, the blade unit comprising a moulded plastics housing providing a comb-like guard portion and a comb-like cap portion between which the blade or tandem blades with a spacer therebetween is/are clamped, the teeth of the two comb-like portions being interconnected by a web which is sufficiently thin to be flexible, and the blade unit further comprising a comb-like moulding of a mixture of polyethylene oxide and a structural polymer, positioned between the teeth of the comb-like cap portion, the teeth of the polyethylene oxide-containing moulding being narrower than the space between the teeth of the cap portion so that the blade unit can flex concavely.

The teeth of the polyethylene oxide-containing moulding are preferably level with or project above the teeth of the cap portion.

The use of inserts formed of a mixture of polyethylene oxide and a structural polymer, such as polystyrene, in the cap and/or the guard portions of razors and blade units to improve shaving performance is known and has been described, for example, in British Specification 2024082. Such inserts typically contain, by weight, 80% of polyethylene oxide and 20% of structural polymer.

The present invention provides a particularly convenient way of incorporating polyethylene oxide-containing inserts in a flexible blade unit of the kind described.

DESCRIPTION OF THE PREFERRED EMBODIMENT

A currently preferred embodiment of the invention will now be described, by way of example, with reference to the accompanying drawings, in which.

Figure 1:
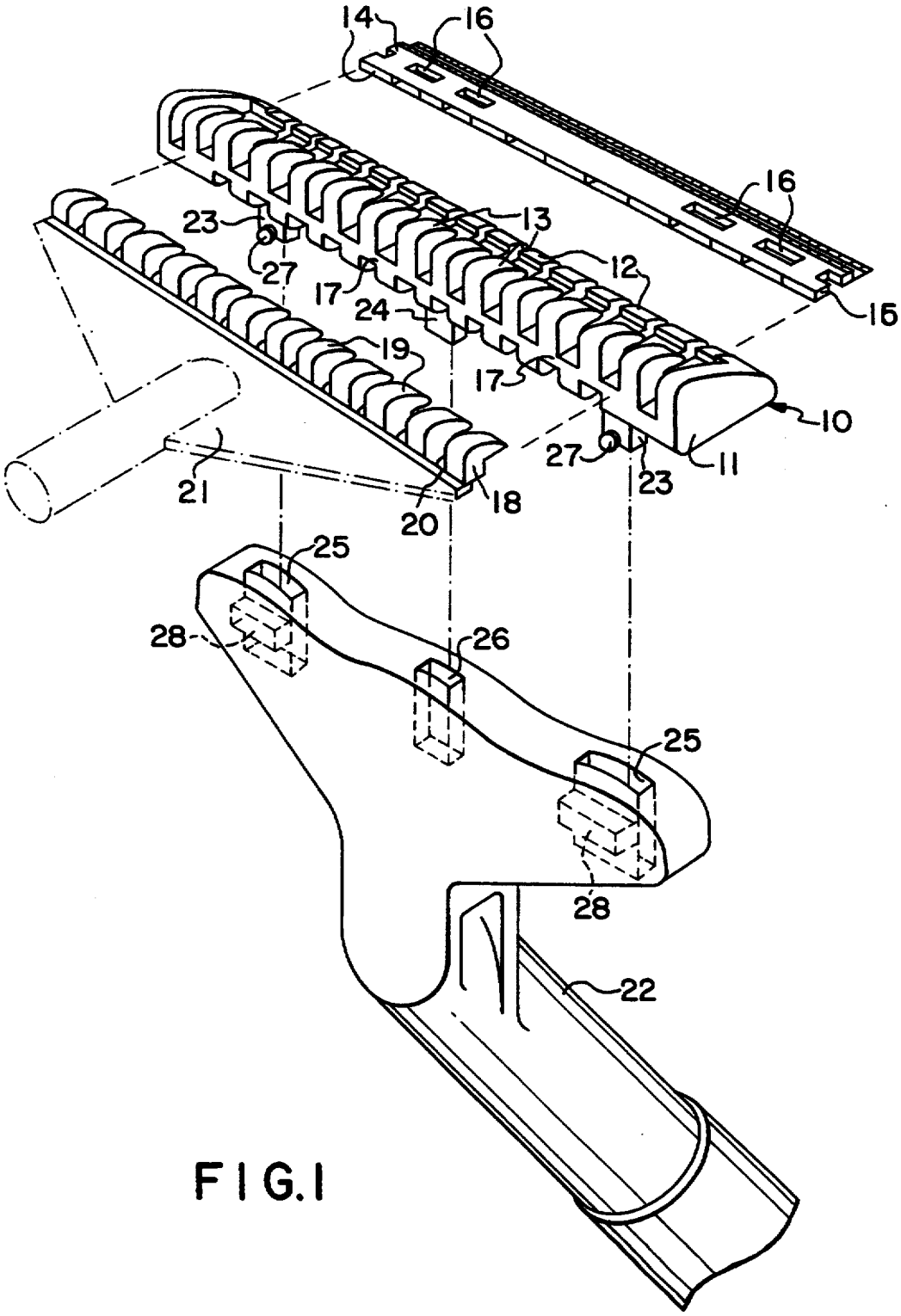
FIG. 1 is a perspective exploded view of the razor.

The illustrated razor comprises a flexible blade unit 10 which comprises a moulded plastics housing 11 (made, for example, from polystyrene) which has a comb-like guard portion 12 and a comb-like cap portion 13 between which a combination of tandem single edged razor blades 14 with a spacer 15 therebetween is clamped. The blades 14 and spacer 15 are retained in the correct position by protrusions (not shown) in the housing and protrusions (not shown) on the spacer 15 which engage in slots 16 in the blades. Slots are used so as to allow relative movement of the blades and spacer during flexing. The teeth of the comb-like portions 12 and 13 are interconnected by a web 17 which is sufficiently thin for the blade unit 10 to be flexible.

The blade unit further comprises a comb-like polyethylene oxide-containing moulding 18, the teeth 19 of which are positioned between the teeth of the cap portion 13, the width of the teeth 19 being less than the space between the teeth of the cap portion (when the blade unit is unflexed) so that the blade unit can flex concavely.

The teeth 19 of the polyethylene oxide-containing moulding 18 are interconnected by a web 20 which is adhesively secured to the back of the web 17. As can be seen from FIG. 2, in the assembled condition, the teeth 19 of the polyethylene oxide-containing moulding 18 are level with the teeth 13 of the cap portion.

Figure 2:
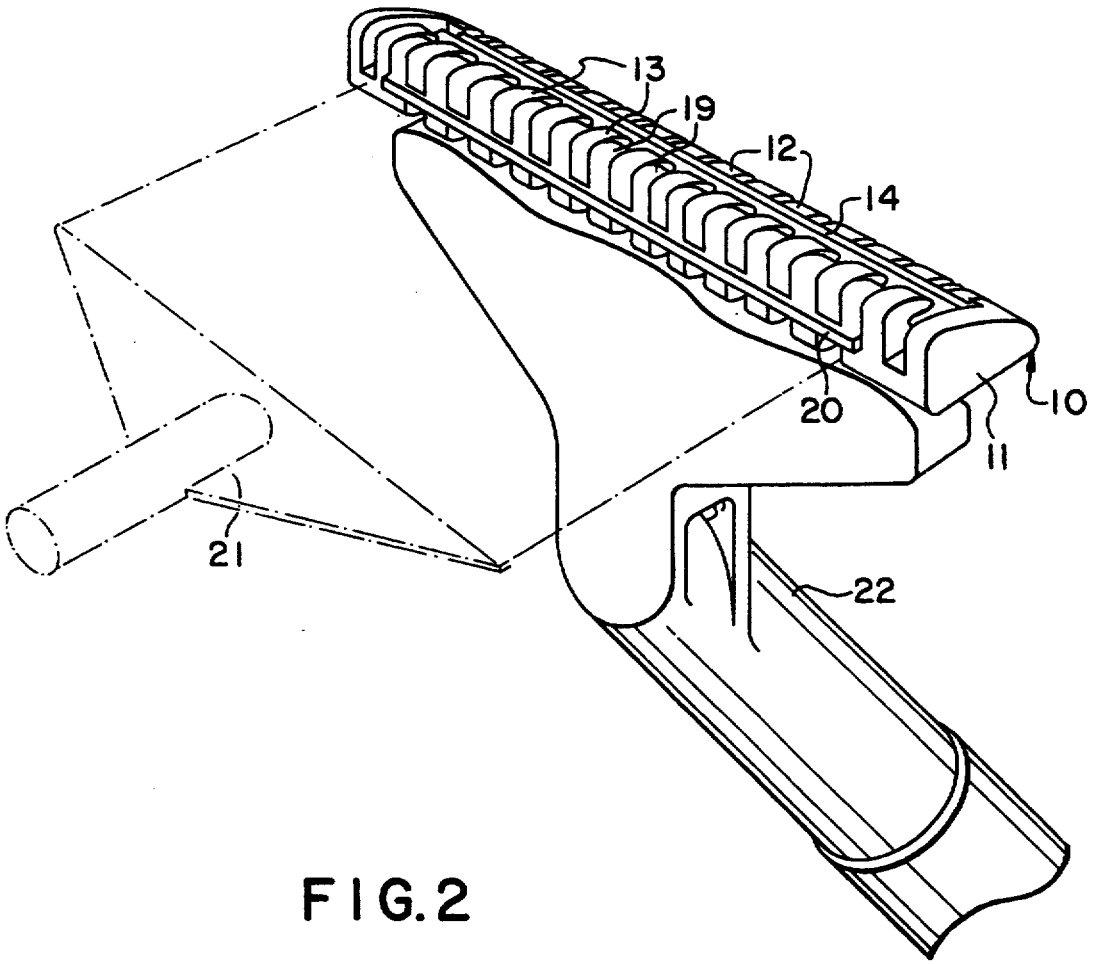
FIG. 2 is a similar view of the assembled razor.

FIGS. 1 and 2 further illustrate a preferred manner of assembling the blade unit, that is the polyethylene oxide-containing moulding 18 is not separated from the sprue 21 with which it is moulded until the moulding 18 has been bonded to the housing 11; the sprue 21 is then cut away (see FIG. 2).

The blade unit 10 is connected to a handle 22 by means of three posts 23,24 depending integrally from the underside of the housing 11 which slidably engage in corresponding slots 25,26 in the head of the handle. The posts 23,24 extend perpendicularly to the parallel planes of the blades and are positioned directly underneath the blade edges, i.e. passing through a region bordered by the blade edges. The central post 24 is guided for rectilinear sliding movement within the slot 26; this post therefore centralises the unit longitudinally, without interfering with its flexure. The outer posts 23 each have a pivot pin 27 projecting through them, parallel with the axis or axes of flexure of the blade unit, and these pins 27 are received in and guided by elongate slots 28 formed in the walls of the slots 26, so that they accommodate flexure of the blade unit, which is accompanied by movement of the ends of the unit towards and away from each other. The pins 27 also prevent withdrawal of the blade unit from the handle.

The posts 23 are set in from the ends of the unit so as to permit the blade unit to flex convexly if one or both ends encounter larger forces during shaving than the medial portion of the unit.

In order to protect the blade unit from damage due to excessive flexure in both concave and convex modes it has been found necessary to limit deflection both at the centre and at the ends of the cartridge.

In the concave mode, deflection from the unflexed plane is limited by abutment of the underside of the platform with the centre of the head of the handle. In the convex mode, deflection of the outer portions of the blade unit is limited by abutment of the underside of the outer portions of the platform with outer portions of the handle head.

In a particular embodiment the concave deflection is limited to 2.5 mm at the centre, and the convex deflection is limited to 3 mm at the ends, of the blade unit. The spacing of the outer posts 23 is preferably $\frac{2}{3}$ of the overall length of the blade unit.

The main forces encountered during shaving are directed perpendicular to the plane of the blades (or blade) and passing through a region bordered by the cutting edges of a tandem blade unit. Since the posts 23,24 are aligned with those forces, they do not encounter any substantial bending moment which would otherwise tend to tilt them and create a tendency for the pins 27 to bind in the guide slots 28.

Whilst we have described an embodiment in which the polyethylene oxide-containing moulding is made separately from the housing 11 and is adhesively bonded to the latter, the polyethylene oxide-containing moulding can be made in situ by a two stage moulding process, namely a process in which different materials are moulded into a single component by moulding one material first and then moulding the second in situ. This process can be used to mould the housing and the polyethylene oxide-containing moulding as a single component (spacing pieces being inserted into the mould before the injection of the polyethylene oxide-containing mixture to provide the desired gaps between the cap teeth and the teeth of the polyethylene oxide-containing moulding. This eliminates the need for adhesive bonding and the reduction in the flexibility of the unit which might arise from the use of an adhesive.

I claim:

1. A safety razor which comprises a razor blade unit having at least one generally planar blade with a cutting edge, which blade unit is readily flexible about an axis or axes parallel with the plane of said at least one blade and extending substantially perpendicular to the cutting edge thereof;

a handle; and, connecting means disposed cooperatively on said blade unit and said handle for connecting the blade unit to the handle which means permits flexing of the blade unit, the blade unit comprising:

a molded plastic housing including:

a guard portion having spaced apart teeth interconnected by a thin, flexible web;

a cap portion having spaced apart teeth interconnected by a thin, flexible web;

said at least one blade being clamped between said cap portion and said guard portion.

said blade unit further comprising a molding having spaced apart teeth interconnected by a thin, flexible web, said molding including a mixture of polyethylene oxide and a structural polymer, the teeth of said molding positioned between the teeth of said cap portion, the teeth of the polyethylene oxide-containing molding being narrower than the space between the teeth of the cap portion so that the blade unit can flex concavely.

2. A razor according to claim 1, in which the teeth of the polyethylene oxide-containing moulding are level with or project above the teeth of the cap portion.

* * * * *